United States Patent [19]

Kassai

[11] Patent Number: 4,759,557

[45] Date of Patent: Jul. 26, 1988

[54] TOY VEHICLE

[75] Inventor: Kenzou Kassai, Osaka, Japan

[73] Assignee: Aprica Kassai Kabushikikaisha, Osaka, Japan

[21] Appl. No.: 17,065

[22] Filed: Feb. 20, 1987

[30] Foreign Application Priority Data

Feb. 25, 1986 [JP] Japan ..... 61-40738

[51] Int. Cl.[4] ..... A63G 19/00

[52] U.S. Cl. ..... 280/1.165; 280/1.14; 280/1.188; 280/1.189; 280/1.201; 446/280

[58] Field of Search ..... 280/1.13, 1.14, 1.188, 280/1.201, 1.22, 1.1 R, 1.11 R, 87.02 R, 1.202, 1.206, 1.208, 289 H; 446/29, 270, 280, 287; D21/76, 78; 350/289 R

[56] References Cited

U.S. PATENT DOCUMENTS 385,910 7/1888 Clark ..... 446/29
2,529,749 11/1950 Wade et al. ..... 280/1.11 R
3,093,925 6/1963 Greene ..... 446/29
4,264,080 4/1981 Kassai .
4,497,500 2/1985 Mercurio ..... 280/1.13

FOREIGN PATENT DOCUMENTS 1019160 10/1952 France ..... 280/289 H

*Primary Examiner*—John J. Love
*Assistant Examiner*—Donn McGiehan
*Attorney, Agent, or Firm*—W. G. Fasse; D. H. Kane, Jr.

[57] ABSTRACT

A toy vehicle (1) comprising a vehicle body (2), front and rear wheels (3 and 4) disposed under the vehicle body to support the latter, a seat (5) and a handle post (7) provided with grips (6). The portion of the handle post projecting upwardly from the vehicle body is provided with a formation or structure which serves as a child's plaything, such as a shape simulating the head (10) of an animal or a music box (50) contained therein. The portion of the handle post projecting downward from the vehicle body supports an axle (9) for the front wheels and is provided with a cushioning mechanism (29), a height adjusting mechanism, and a mechanism for operating an operable object (37, 47) installed in connection with the handle post.

7 Claims, 10 Drawing Sheets

TOY VEHICLE

BACKGROUND OF THE INVENTION

1. Field of the Invention

This invention relates to a toy vehicle, and particularly to improvements in a handle post which is provided in a toy vehicle.

2. Description of the Prior Art

A toy vehicle to be enjoyed by a child who rides it comprises a vehicle body, and front and rear rotatable wheels disposed under said vehicle body to support the latter, the upper surface of said vehicle body being formed with a seat for a chile to sit on. Disposed forwardly of the seat is a handle post provided with child's grips for a child which projects upwardly from the vehicle body. Such toy vehicles are propelled by a child who sits on the seat, with his hands holding the grips and his feet kicking the ground. Such grips are fixed to the handle post and in some design they are also fixed to the vehicle but in other designs they serve as a steering handle. In the case where the grips serve as a steering handle, they are rotatively operated whereby the handle post is rotated around its own axis, so that the front wheels connected thereto have their direction changed, thus making it possible to change the direction of travel of the toy vehicle during driving.

To meet various consumer demands, makers of toy vehicles of the type described above prepare various articles which different external appearances or add suitable playthings.

For example, means for changing the external appearance of a toy vehicle at low cost is disclosed in U.S. Pat. No. 4,264,080. In that patent, there is disclosed a technique wherein a portion of a vehicle body of rigid plastic material corresponding to the bonnet is made in the form of a molding separate from the molding of the rest of the vehicle body and then these moldings are integrated. Employing such an arrangement makes it possible to change the external appearance of the toy vehicle at relatively low cost and to offer a variety of toy vehicles with different external appearances. The reason is that the bonnet portion has the greatest influence on the aesthetic design of the entire toy vehicle and that, moreover, the cost of a mold for the bonnet portion alone is lower than that of a mold for the entire vehicle body.

Further, as described above, there is also proposed a toy vehicle having a plaything added thereto. Such a plaything is generally disposed on the bonnet portion or contained below the seat.

SUMMARY OF THE INVENTION

This invention is intended to find a space in which a formation or structure which attracts the consumers' interest can be applied to portions other than the bonnet portion or seat in anticipation of further increasing various consumer demands.

Paying attention to the fact that toy vehicles are almost invariably equipped with a handle post having child's grips, this invention is characterized by providing said handle post with a formation or structure which attracts the consumers' interest.

More particularly, the invention provides a toy vehicle comprising a vehicle body, front and rear rotatable wheels disposed under said vehicle body to support the latter, the upper surface of the vehicle body being formed with a seat for a child to sit on, a handle disposed forwardly of said seat and projecting upwardly from the vehicle body, said toy vehicle being characterized in that a formation or structure whose external appearance or mechanism serves as a child's plaything is applied to said handle post.

According to this invention, the handle post, which conventionally has only the function of a block supporting the grips or the function of transmitting the movement of the grips to the front wheels in the case where the grips serve as a steering handle, can now be provided with an additional function of a plaything.

When the handle post is provided with a certain formation or structure as described above, this results in changing the external appearance of the handle post, which handle post is at a particularly conspicuous location from the standpoint of an aesthetic design for toy vehicles, thereby making it possible to change the visual impression of the entire toy vehicle to a great degree. Particularly, such handle post rises high above the bonnet portion and can be said to be the most conspicuous of all components of the toy vehicle. Thus, paying attention to such handle post means to pay attention to the location which is most efficient in changing the external appearance of the entire toy vehicle.

When a formation or structure serving as a plaything is applied to the handle post, the handle post itself must naturally be increased in size, particularly in diametrical dimension, as compared with a conventional typical handle post. Thus, a mechanism associated with a child's plaything or another mechanism not associated therewith can be stored in such handle post offering an ample room for such storage. Such mechanisms include one for actuating a plaything provided by the handle post itself, another for cushioning the front wheels, and another for changing the height of the vehicle body.

The handle post is located in the vicinity of the front wheels. Therefore, a certain movable body which serves as a plaything can be moved by operative association with the rotation of the front wheels through a relatively short, motion transmitting path.

DESCRIPTION OF THE PREFERRED EMBODIMENTS

Referring to FIGS. 1 through 5, a first embodiment of the invention will now be described.

Figure 1:
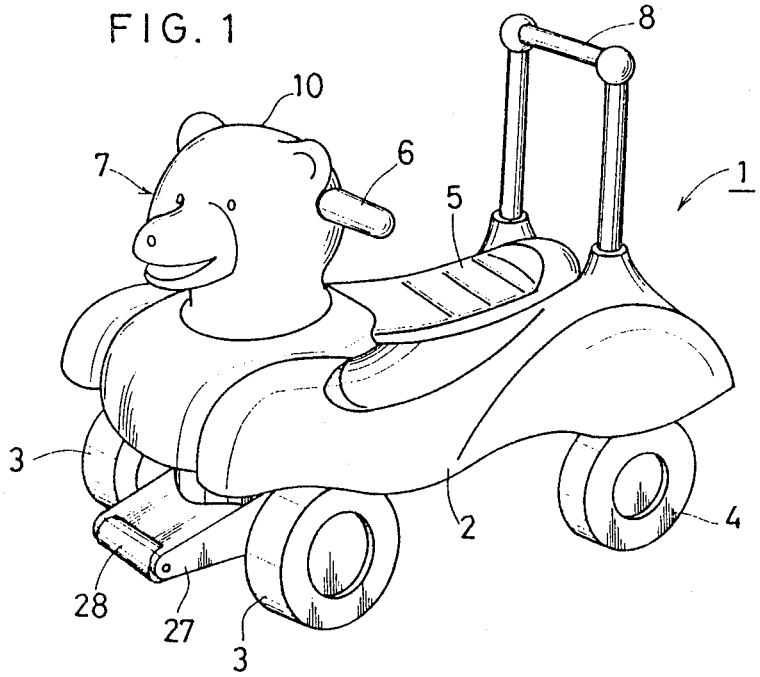
FIG. 1 is a perspective view showing the external view of a toy vehicle 1 according to a first embodiment of the invention.

This toy vehicle 1 has an external appearance as shown in FIG. 1. The toy vehicle 1 comprises a vehicle body 2, and front and rear rotatable wheels 3 and 4 disposed under said vehicle body 2 and supporting the latter. The upper surface of the toy vehicle 2 is formed with a seat 5 for a child to sit on. Disposed forwardly of the seat 5 is a handle post 7 having a pair of child's grips 6 (only one of which is shown), said handle post 7 projecting upwardly from the vehicle body 2. The number of grips and their shape are optional. Details of the arrangement of the handle post 7 will be given later. A manual push rod 8 is installed on the rear end of the vehicle body 2.

Figure 2:
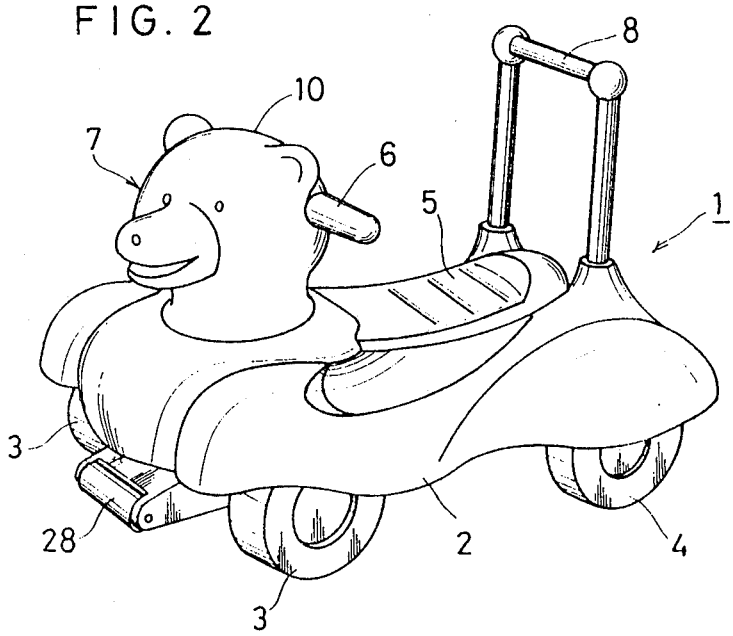
FIG. 2 is a perspective view showing the height-reduced state of the toy vehicle of FIG. 1.

This embodiment is characterized by the shape of the handle post 7. More particularly, a formation which serves as a child's plaything because of its external appearance is applied to the handle post 7. More particularly, it is a formation simulating the head of an animal such as a bear. The formation provided to the handle post 7 may be one which simulates other animal's head or a human being's head. The handle post 7 is increased in size, as shown, and this increased space can be utilized to install various functions therein. In this embodiment, an arrangement is employed which is capable of reducing the height of the vehicle body 2, as shown in FIG. 2, and cushioning the front and rear wheels 3 and 4.

Figure 3:
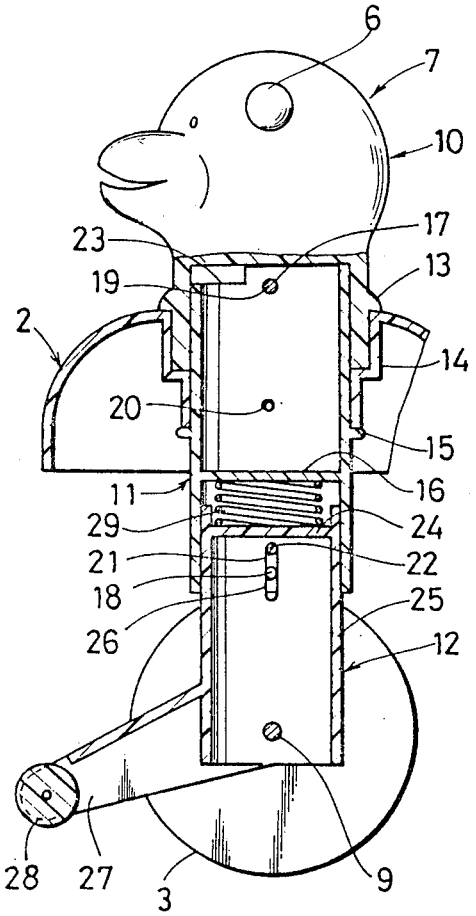
FIG. 3 is a sectional view showing an arrangement associated with a handle post 7 in the state of FIG. 1.

As shown in FIG. 3, the handle post 7, as a whole, extends downward through the vehicle body 2 and has an axle 9 attached to the lower end thereof for supporting the front wheels 3. The handle post 7 is held in the vehicle body 2 so that it is rotatable around its axis. In this embodiment, the handle post 7 is divided into three parts, a head portion 10, an intermediate portion 11 and a lower portion 12, which are telescopically put together.

The head portion 10 is exposed above the vehicle body 2, has the shape of an animal's head, as described above, and is formed with grips 6. The lower end portion of the head portion 10 is a hollow cylinder, and this cylindrical lower end portion is formed with a flange 13 extending outward therefrom. The region below the flange 13 is received in a portion of relatively large diameter in the upper half of a cylindrical support seat 14 formed on the vehicle body 2.

The intermediate portion 11 is cylindrical, as a whole, and is formed with an outwardly extending flange 15 at a position which bisects the longitudinal dimension. The intermediate portion 11 which is cylindrical is internally formed with a partition wall 16. The partition wall 16 is located at a position deviated to one side when seen longitudinally of the intermediate portion 11, i.e., deviated downward when seen in FIG. 3. The intermediate portion 11 is formed with two attaching holes 17 and 18 at vertically spaced symmetrical positions, said attaching holes being selectively used. In the state shown in FIG. 3, a set screw 19 is inserted in one attaching hole 17, while the other attaching hole 18 is left vacant. The intermediate portion 11 is formed with guide pin receiving holes 20 and 21 at positions on opposite sides of the partition wall 16, which positions are substantially equally spaced from the partition wall 16. These guide pin receiving holes 20 and 21 are selectively used to receive a guide pin 22; in the state of FIG. 3, the guide pin 22 is received in the lower guide pin receiving hole 21. The upper guide pin receiving hole 20 is left vacant. The upper end of the intermediate portion 11 in FIG. 3 is formed with a notch 23. This notch 23 is provided to allow cushioning action to take place in the state of FIG. 4 to be later described.

The intermediate portion 11 arranged in the manner described above is inserted into the lower end portion of the head portion 10 from below the support seat 14. Then, the set screw 19 is inserted in the attaching hole 17 and an attaching hole (not shown) formed at the corresponding position on the head portion 10, whereby the head portion 10 and the intermediate portion 11 are mechanically fixed together. At this time, the flanges 13 and 15 hold the support seat 14 of the vehicle body 2 from above and below, so that the assembly of the head portion 10 and intermediate portion 11 is prevented from slipping out of the vehicle body 2.

The lower portion 12 comprises a cylindrical portion 25 having a spring support wall 24 adjacent its upper end. The axle 9 described above is retained by this cylindrical portion 25. The cylindrical portion 25 is formed with a vertically extending guide opening 26. The cylindrical portion 25 is formed with an arm 27 extending obliquely downward therefrom, the free end of said arm 27 having a toppling-preventing roller 28 attached thereto.

With the arm 27 directed so that it extends forward, the cylindrical portion 25 is fitted into the intermediate portion 11 from below; in this manner the lower portion 12 is fitted into the intermediate portion 11. At this time, a cushion spring 29 in the form of, e.g., a coil spring, is interposed between the partition wall 16 and the spring support wall 24. The guide pin 22 is then inserted so that it extends through the guide opening 26 and one guide pin receiving hole 21. In this state, the lower portion 12 is inhibited from turning around its axis relative to the intermediate portion 11 while it is allowed to vertically move to the extent that the guide opening 26 extends or until the upper end surface of the lower portion 12 abuts against the partition wall 16. At this time, the cushion spring 29 operates to exert a suitable cushioning action on the front wheels 3.

The state shown in FIG. 3 described above corresponds to the state shown in FIG. 1 in which the vehicle body 2 assumes a relatively high position. In this state, if the child sitting on the seat 5 grasps the grips 6 with his hands and rotates the handle post 7, the direction of the front wheels 3 is changed and hence the direction of travel of the toy vehicle 1 can be changed. The purpose of toppling-preventing roller 28 is to prevent the toy vehicle 1 from toppling forward. Following the movement of the handle post 7, this roller changes its position so that it is always directed in the direction of travel of the front wheels 3.

Figure 4:
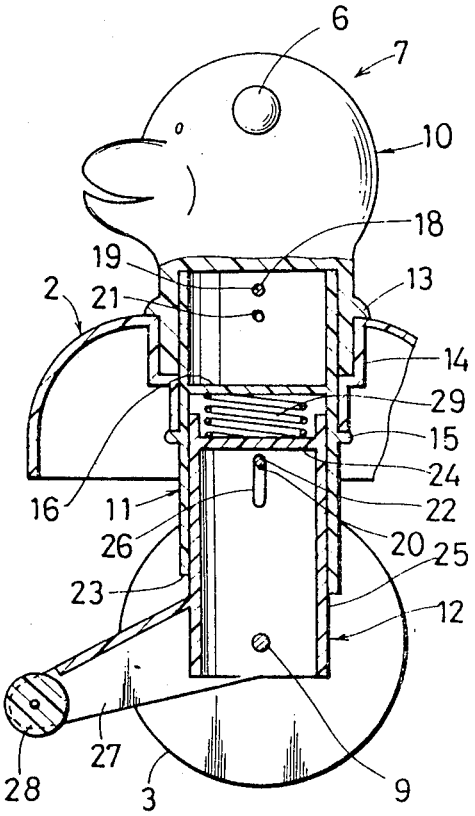
FIG. 4 is a sectional view showing the handle post 7 in the state of FIG. 2.

The state in which the height of the vehicle body 2 is reduced as shown in FIG. 2 is attained by vertically inverting the intermediate portion 11 of the handle post 7, as shown in FIG. 4. At this time, the set screw 19 is attached so that it extends through the attaching hole 18. Further, the guide pin 22 is installed to extend through the guide pin receiving hole 20. When the intermediate portion 11 is vertically inverted in this manner, the effective length of the intermediate portion 11 is reduced, bringing the front wheels 3 closer to the vehicle body 2.

In the state shown in FIG. 4 also, the cushioning action by the cushion spring 29 is exerted. The purpose of the notch 23 described above is to avoid interference between the intermediate portion 11 and the arm 27 when the lower portion 12 is vertically moved relative to the intermediate portion 11.

In this embodiment, the height adjusting mechanism and the cushioning mechanism described above are also provided in connection with the rear wheels 4, and consideration has been given so that the same parts can also be used for the rear wheels 4. This arrangement associated with the rear wheels 4 is shown in FIG. 5.

Figure 5:
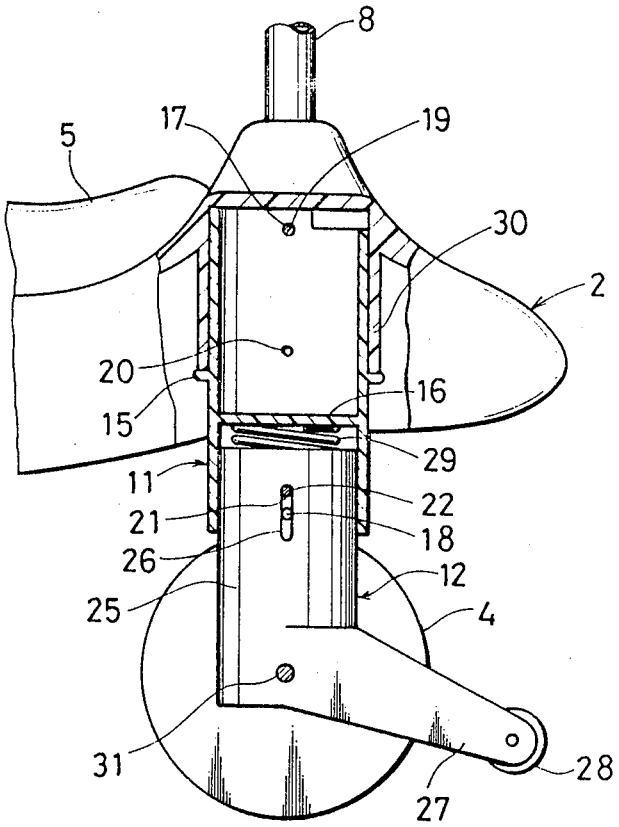
FIG. 5 is a fragmentary view, partly in section, showing an arrangement associated with a rear wheel 4 shown in FIG. 1.

In FIG. 5, the state in which the vehicle body 2 is at a relatively high position, as in FIGS. 1 and 3, is shown. Therein, the intermediate portion 11 and lower portion 12 constituting the aforesaid handle post 7 as well as the cushion spring 29 are used in common. Therefore, the corresponding parts are indicated by the same reference numerals, and a repetitive description thereof is omitted.

The arrangement associated with the rear wheels 4 shown in FIG. 5 differs from the one associated with the front wheels 3 only in the following point.

The intermediate portion 11 is inserted in a support seat 30 formed on the rear portion of the vehicle body 2 and is fixed by a set screw 19. In other words, the intermediate portion 11 need not be rotatable relative to the vehicle body 2. Further, the lower portion 12 is inserted in the intermediate portion 11 so that its arm 27 is directed backward. Thus, the toppling-preventing roller 28 prevents the toy vehicle from toppling backward. The lower portion 12 holds an axle 31 for the rear wheels 4. The rest of the arrangement is the same as in the front wheels 3. Thus, when it is desired to reduced the height of the vehicle body 2, the intermediate portion 11 will be vertically inverted.

Rather than using the same parts for the front and rear wheels 3 and 4 as in this embodiment, different parts may, of course, be used.

Figure 6:
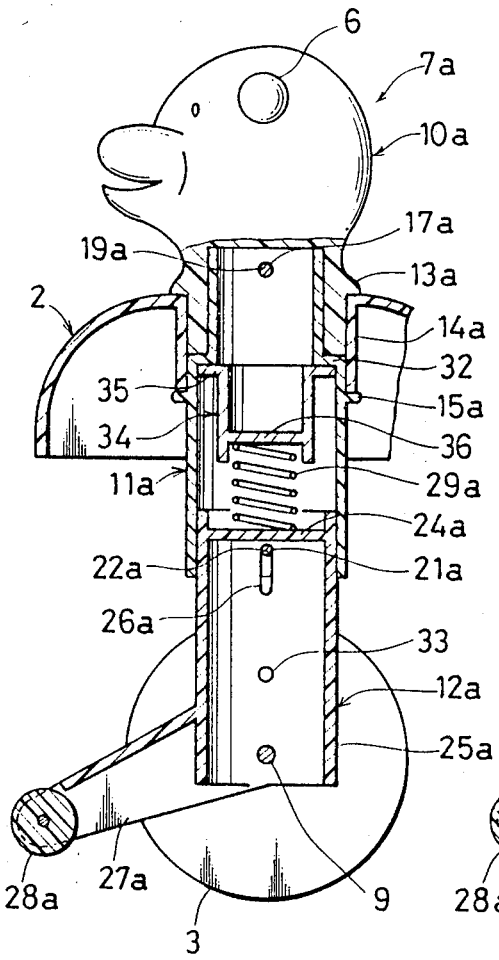
FIG. 6 is a sectional view showing a second embodiment of the invention, particularly illustrating an arrangement associated with a handle post 7*a;*
Figure 7:
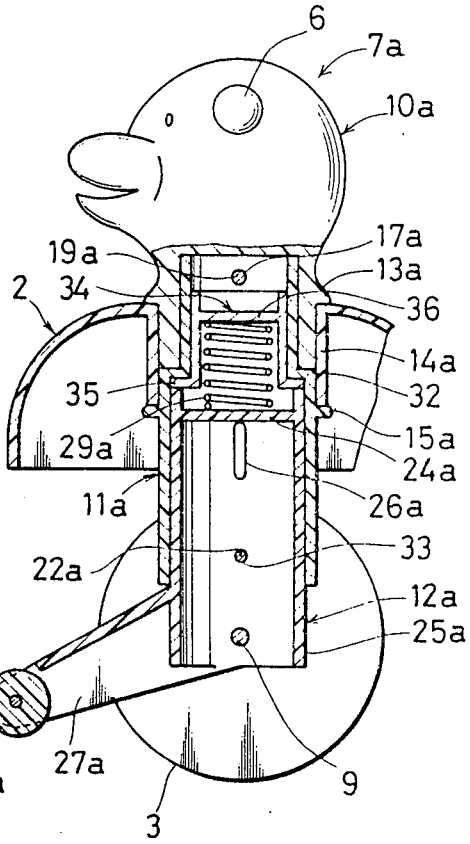
FIG. 7 is a sectional view showing the height-reduced state of the handle post 7*a* of FIG. 6.

FIGS. 6 and 7 show a second embodiment of the invention, particularly illustrating modifications of the height adjusting mechanism and cushioning mechanism shown in FIGS. 3 and 4.

First, referring mainly to FIG. 6 showing the vehicle body 2 at a relatively high position, the arrangement of a handle post 7a will be described. The handle post 7a, like the handle post 7 shown in FIG. 3 described above, comprises a combination of three parts, a head portion 10a, an intermediate portion 11a and a lower portion 12a, which are telescopically put together.

The head portion 10a is constructed in substantially the same manner as in the head portion 10 shown in FIG. 3, and it is formed with grips 6 and is cylindrical in its lower end portion, where a flange 13a is formed. The vehicle body 2 is formed with a substantially cylindrical support seat 14a for receiving the lower end portion of the head portion 10a.

The intermediate portion 11a is substantially cylindrical, and its middle portion, as seen in the direction of the axis, is formed with a step portion 32, the portion above said step portion 32 being relatively smaller in diameter than the portion below the step portion 32. The lower half of relatively large diameter is formed with an outwardly extending flange 15a.

The intermediate portion 11a is inserted in the lower end portion of the head portion 10a from below until the flange 15a abuts against the lower end surface of the support seat 14a. A set screw 19a extending through the attaching hole 17a formed in the upper portion of the intermediate portion 11a also extended extends through the head portion 10a, whereby the head portion 10a and the intermediate portion 11a are fixed together. The lower portion of the intermediate portion 11a is formed with a guide pin receiving hole 21a for receiving the guide pin 22a.

The lower portion 12a is constructed in substantially the same manner as the lower portion 12 shown in FIG. 3 described above. In the lower portion 12a shown in FIG. 6, the components corresponding to those included in the lower portion 12 of FIG. 3 are indicated by the reference numerals used in FIG. 3 with the subscript "a" added thereto, and the description given above also applies here, also. The lower portion 12a of FIG. 6 is also formed with a guide pin receiving hole 33.

In the embodiment shown in FIGS. 6 and 7, a cushion spring 29a is used to give a cushioning effect, and a spring support member 34 is used to receive the upper end of the cushion spring 29a. The spring support member 34 is cylindrical as a whole and is formed at one end thereof with an outwardly extending flange 35. It is also formed adjacent its other end with a spring support wall 36.

In the state shown in FIG. 6, the spring support member 34 is used with the flange 35 at the top. That is, the spring support member 34 is inserted into and intermediate portion 11a from below until the flange 35 abuts against the step portion 32. The cushion spring 29a is then inserted into the intermediate portion 11a so that its upper end is received by the spring support wall 36, and then the lower portion 12a is inserted from below. The guide pin 22a, which extends through the guide opening 26a, is inserted in the guide pin receiving hole 21a. In this state, the lower portion 12a is vertically movable relative to the intermediate portion 11a to the extent that the guide opening 26a extends. The cushioning action is exerted in that the upward movement of the lower portion 12a is attained against the resilience of the cushion spring 29a.

When it is desired to reduce the height of the vehicle body 2 as shown in FIG. 7, the spring support member 34 will be vertically inverted. That is, with the flange 35 positioned at the bottom, the spring support member 34 is inserted into the intermediate portion 11a from below until the flange 35 engages the step portion 32. The cushion spring 29a is inserted in the spring support member 34 and then the lower portion 12a is inserted into the intermediate portion 11a from below. At this time, the upper end surface of the lower portion 12a abuts against the flange 35 of the spring support member 34, bringing the front wheels 3 closer to the vehicle body 2. The guide pin 22a is inserted so that it extends through the guide pin receiving hole 33 of the lower portion 12a and the guide pin receiving hole 21a of the intermediate portion 11*a* (FIG. 6), whereby the lower portion 12*a* is fixed to the intermediate portion 11*a*.

In the state of FIG. 7 described above, there is no cushioning action exerted by the cushion spring 29*a*. However, it is also possible to exert a cushioning action in the state of FIG. 7 by providing a clearance between the upper surface of the lower portion 12*a* and the flange 35, and a second clearance between the lower end of the intermediate portion 11*a* and the arm 27*a*, and converting the guide pin receiving hole 33 or 21*a* into a vertically extending elongated opening.

Though not shown, the arrangement shown in FIGS. 6 and 7 is applicable also to the rear wheels 4 as in the case of the first embodiment described above.

Figure 8:
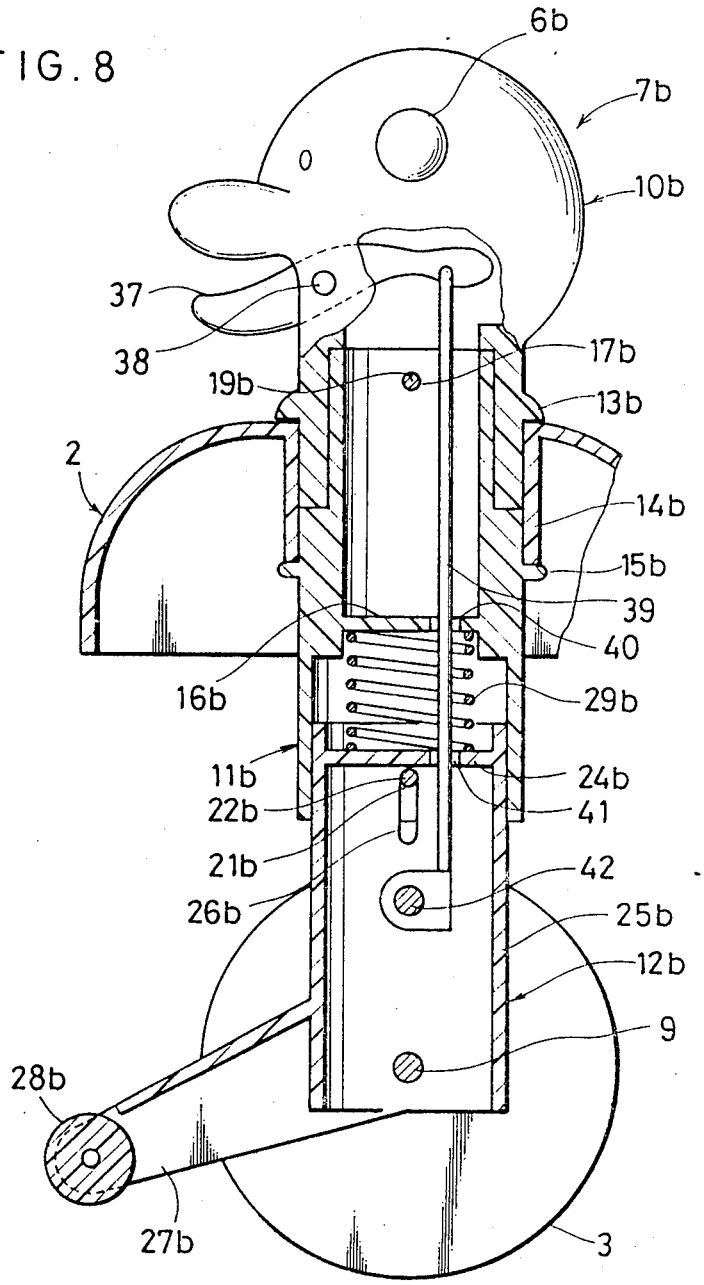
FIG. 8 is a sectional view showing a third embodiment of the invention, particularly illustrating an arrangement associated with a handle post 7*b;*

FIG. 8 shows a third embodiment of the invention, wherein the handle post is provided with an operable portion.

The handle post 7*b* shown in FIG. 8 is basically similar to the handle post 7 shown in FIG. 3, and to simplify the description, the components corresponding to those shown in FIG. 3 are indicated by the reference numerals used in FIG. 3 with the substript "b" added thereto, and the description given above also applies here.

The lower jaw portion 37 of an animal represented by the head portion 10*b* of the handle post 7*b* shown in FIG. 8 is swingable in a vertical plane around the axis of a pivot pin 38. The base end of the lower jaw portion 37 is disposed within in the hollow head portion 10*b* and the upper end of a connecting rod 39 is rotatably connected thereto. The connecting rod 39 extends downward through through-holes 40 and 41 formed in the partition wall 16*b* and spring support wall 24*b* until its lower end enters the cylindrical portion 25*b* of the lower portion 12*b*. The lower end of the connecting rod 39 is rotatably connected to the lower portion 12*b* by a connection pin 42.

In the arrangement describe above, when the lower portion 12*b* is vertically displaced relative to the intermediate portion 11*b* under the action of the cushion spring 29*b*, the movement of the lower portion 11*b* relative to the intermediate portion 11*b* is transmitted to the lower jaw portion 37 through the connecting rod 39. Therefore, in operative association with the cushioning action, the lower jaw portion 37 is swung around the axis of the pivot pin 38.

According to this embodiment, in operative association with the cushioning action, part of the handle post 7*b* is operated, and this operation is visually perceptible; thus, an interesting toy vehicle can be provided.

In the above embodiment, the handle post 7*b* is of substantially hollow construction with the connecting rod 39 extending therein; therefore, the entire handle post 7*b* can be compactly constructed. However, if such merit is not desired, a member corresponding to the connecting rod 39 may be disposed outside the handle post.

Figure 9:
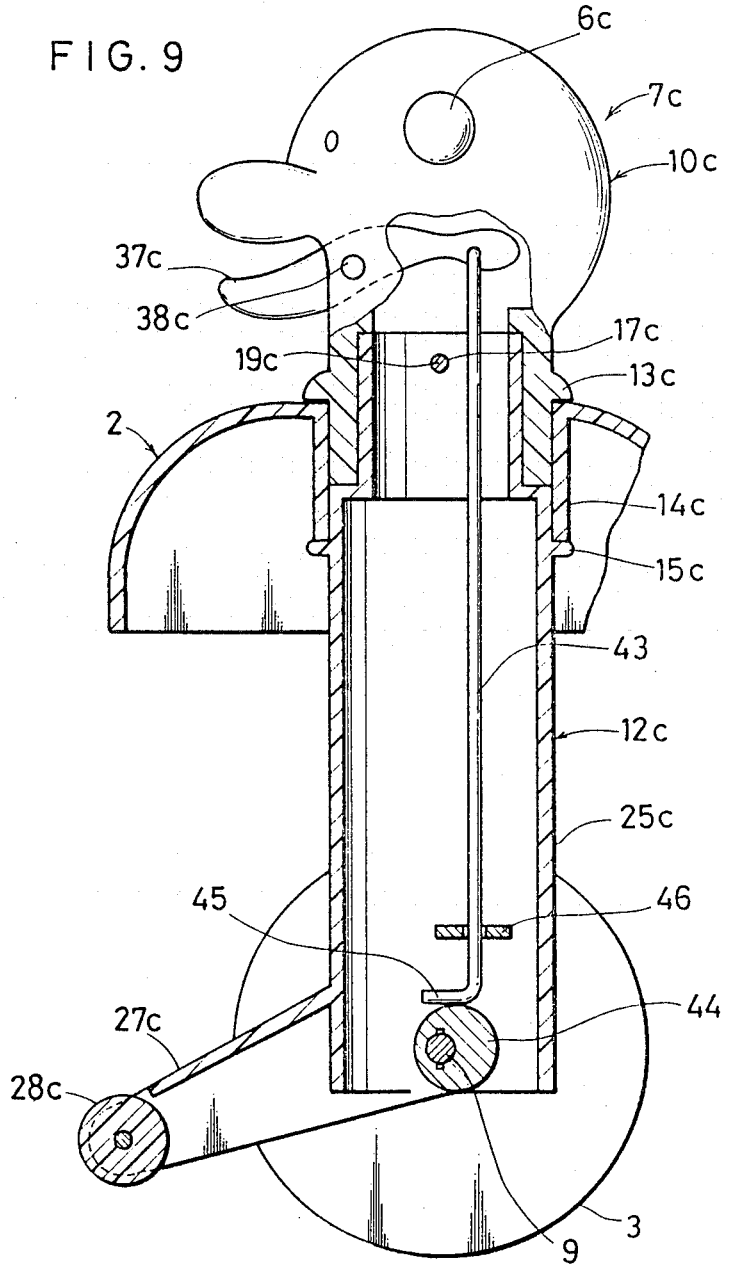
FIG. 9 is a view showing a fourth embodiment of the invention, particularly illustrating an arrangement associated with a handle post 7*c;*

FIG. 9 shows a fourth embodiment of the invention, wherein the handle post is provided with an operable portion which is adapted to be driven in operative association with the rotation of the front wheels.

The handle post 7*c* shown in FIG. 9 is divided into a plurality of parts as in the preceding embodiments in consideration of the operation for attaching it to the vehicle body 2. In this embodiment, since there is no need for cushioning, it is divided into two parts, a head portion 10*c* and a lower portion 12*c*. Considered from a functional point of view, however, there are many parts in common with the construction shown in FIG. 3. Thus, the corresponding parts are indicated by the reference numerals used in FIG. 3 with the subscript "c" added thereto, and the description given above applies here.

In the embodiment of FIG. 9 also, the lower jaw 37*c* of an animal represented by a head portion 10*c* is pivotally mounted on a pivot pin 38*c*. The upper end of a cam follower rod 43 is rotatably connected to the base end portion of the lower jaw 37*c*. The cam follower rod 43 is guided through the handle post 7*c* which is of substantially hollow construction its length being such that it reaches almost to the axle 9. The axle 9 has a cam 4 of suitable shape fixed thereon, and the camming surface of the cam 44 is contacted by a contact portion 45 formed on the lower end of the cam follower rod 43. The cam follower rod 43 is guided through a guide member 46 disposed at a suitable position in its path to ensure contact of the contact portion 45 with the cam 44, whereby lateral deviation of the cam follower rod 43 is prevented.

In the arrangement described above, as the front wheels 3 are rotated, the cam 44 is rotated, vertically moving the cam follower rod 43. Thereby, the lower jaw portion 37*c* is swung around the axis of the pivot pin 38*c*. Thus, according to this embodiment, when the toy vehicle is driven, the lower jaw portion 37*c* is automatically swung.

Figure 10:
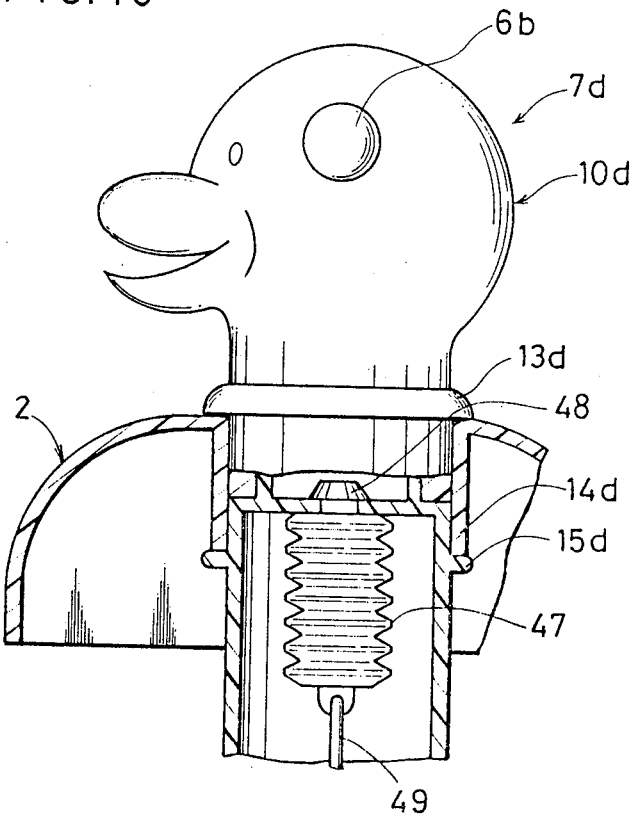
FIG. 10 is a sectional view showing a fifth embodiment of the invention, particularly illustrating an arrangement associated with a handle post 7*d;*

FIG. 10 shows a fifth embodiment of the invention, wherein the middle post is provided with an operable portion which cannot be visually perceptible.

In FIG. 10, the upper half of the handle post 7*d* alone is shown. This embodiment is intended to operate a bellows 47 instead of the lower jaw 37 or 37*c* in the embodiments respectively shown in FIGS. 8 and 9. When the bellows 47 is expanded and contracted, it feeds air to a whistle 48 to blow the latter. The bellows 47 is expanded and contracted by the vertical movement of a driving rod 49 connected to the lower end of the bellows 47. If this driving rod 49 is composed of a member corresponding to the connecting rod 39 shown in FIG. 8, the whistle 48 can be blown in operative association with the cushioning action. Alternatively, if it is composed of a member corresponding to the cam follower rod 43 shown in FIG. 9, the whistle 48 can be blown as the front wheels 3 are rotated.

In FIG. 10, the portions corresponding to those shown in FIG. 3 are indicated by the reference numerals used in FIG. 3 with the subscript "d" added thereto, and a repetitive description thereof is omitted.

Figure 11:
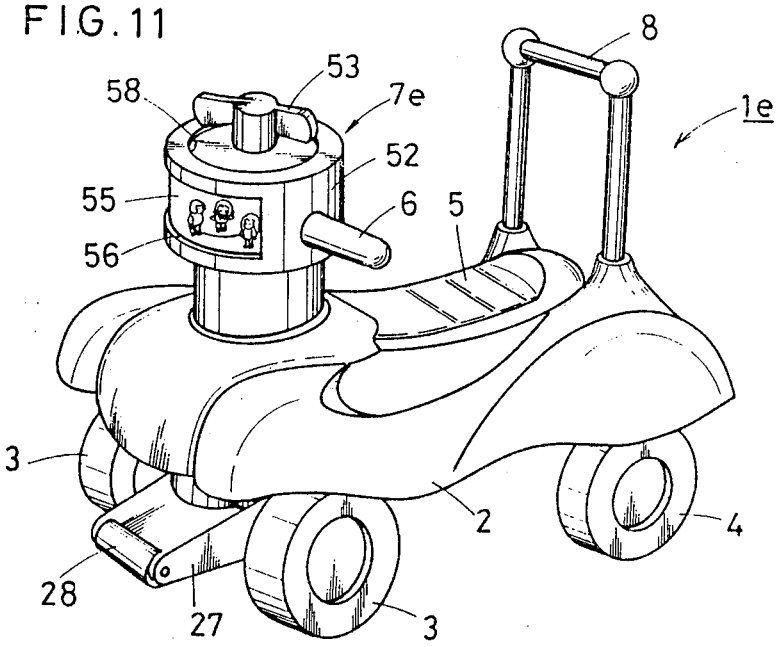
FIG. 11 is a perspective view showing the external appearance of a toy vehicle 1e according to a sixth embodiment of the invention.
Figure 12:
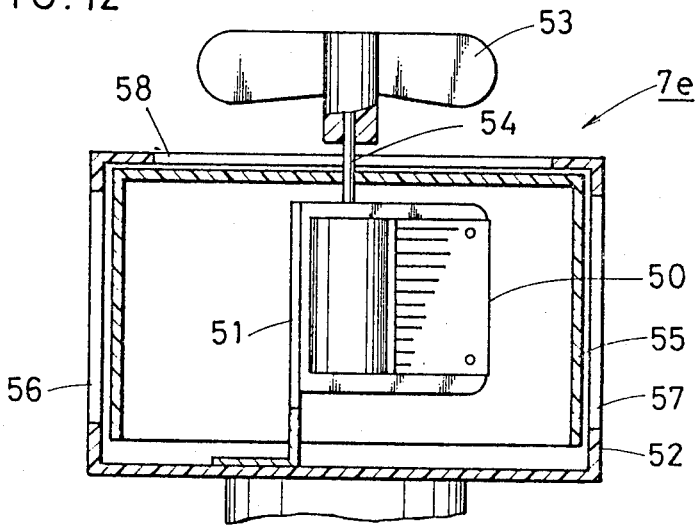
FIG. 12 is a sectional view of a handle post 7e provided on the toy vehicle 1e of FIG. 11.

FIGS. 11 and 12 shows a sixth embodiment of the invention, particularly illustrating a modification of a formation or structure on the handle post. In FIG. 11, the portions in common with the toy vehicle 1 shown in FIG. 1 are indicated by the same reference numerals, and a repetitive description thereof is omitted.

The toy vehicle 1*e* shown in FIG. 11 has a handle post 7*e* whose portion projecting from the vehicle body 2 is substantially cylindrical. The handle post 7*e*, as shown in FIG. 12, contains a music box 50 attached to a case 52 through a bracket 51, which case forms the head portion of the handle post 7*e*. Grips 6 project outwardly from said case 52. The music box 50 is provided with a knob 53 for winding the spring, said knob 53 projecting upwardly from the case 52. A knob shaft 54 on which the knob 53 is fixed has a rotary drum 55 fitted thereon, the bottom of said rotary drum 55 being open. The outer side of the rotary drum 55 has suitable pictures drawn thereon. The lateral surface and top surface of the case 52 are formed with windows 56, 57 and 58 so that the pictures drawn on the rotary drum 55 are visible.

In the above embodiment, the spring of the music box 50 is manually wound using the knob 53 and then the hand is released, whereupon the music box 50 is played and its music can be enjoyed. During the playing of the music box 50, as the spring is unwound, the knob shaft 54 is rotated and so is the rotary drum 55; thus, changes of the pictures drawn on the outer surface of the rotary drum 55 can be enjoyed through the windows 56, 57, and 58.

Figure 13:
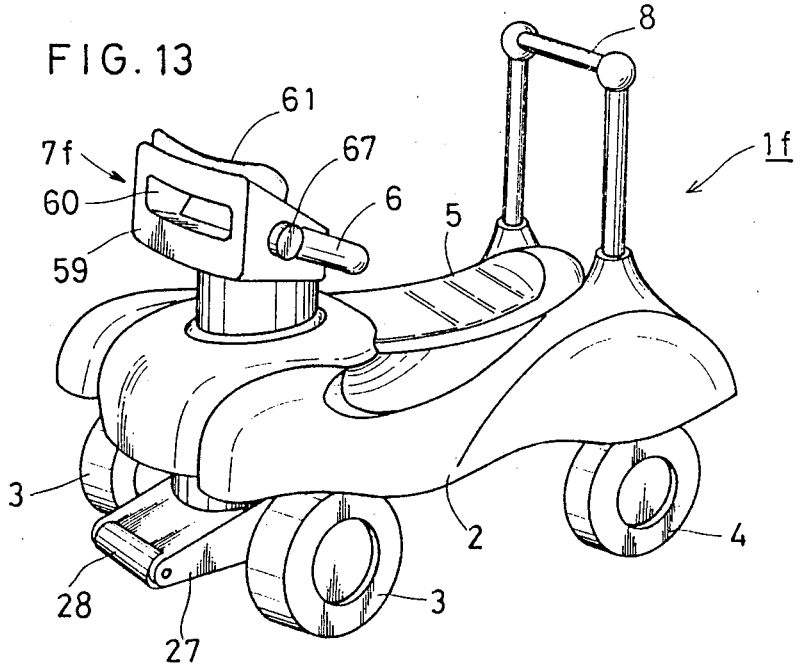
FIG. 13 is a perspective view showing the external appearance of a toy vehicle 1f according to a seventh embodiment of the invention.
Figure 14:
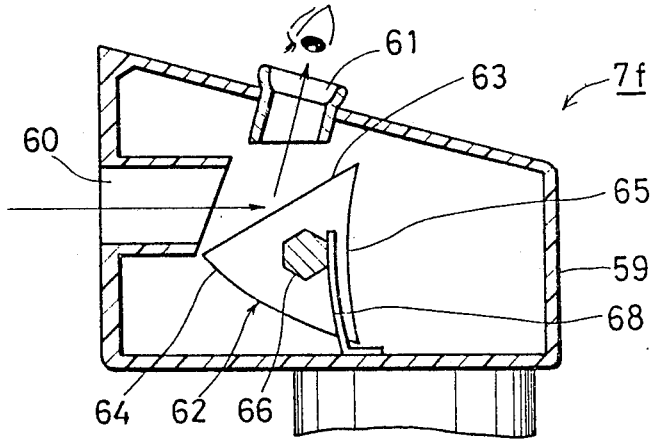
FIG. 14 is a sectional view of a handle post 7f provided on the toy vehicle 1f of FIG. 13.

FIGS. 13 and 14 show a seventh embodiment of the invention, particularly illustrating further modification of the external appearance and construction of the handle post. In FIG. 13, the same portion as those in the toy vehicle shown in FIG. 1 are indicated by the same reference numerals, and a repetitive description thereof is omitted.

The toy vehicle 1*f* shown in FIG. 13 has a handle post 7*f* which forms a peep toy. The head portion of the handle post 7*f* is formed by a hollow case 59 and grips 6 project from said case 59.

The case 59 is formed at its front with a light inlet opening 60 and at its top with a peep window 61. A reflector 62 in the form of a prism is disposed in the case 59 so that the light coming in through the peep window 60 can be reflected toward the peep window 61. The reflector 62, in this embodiment, is a triangular prism having first, second and third reflecting mirrors 63, 64 and 65 formed on its three sides. The first reflecting mirror 63 is planner, the second reflecting mirror 64 is convex, and the third reflecting mirror 65 is concave. The reflector 62 is arranged with its axis directed horizontal. The reflector 62 is held rotatable relative to the case 59 by means of a shaft 66 extending through the reflector axis. Outside the case 59, the shaft 66 is connected to a knob 67. At least a portion of the shaft 66 is hexagonal in cross section, as shown in FIG. 14, and a plate spring 68 fixed at one end thereof to the case 59 is pressed against a side of the hexagon.

With the arrangement made in the manner described above, the reflector 62 can be rotated within the case 59 around the axis of the shaft 66. During rotation of the knob 67, the plate spring 68 is pressed against the lateral surface of the shaft 66 of hexagonal cross section, whereby the knob 67 is braked every 60 degrees of revolution. Therefore, when the reflector 62 is rotated by rotating the knob 67 in either direction, either one of the first, second and third reflecting mirrors 63, 64 and 65 is placed every two brakes in the path of light extending from the light inlet opening 60 to the peep window 61. In fact, when the knob 67 is rotated while viewing through the peep window 61, a series of visual changes can be enjoyed; for example, first, an inverted image of the front scene is visible on the first reflecting mirror 63, second, nothing can be seen, third, an inverted image reduced in vertical size is visible on the second reflecting mirror 64, fourth, nothing can be seen, fifth, a vertically elongated erect image is visible on the third reflecting mirror 65, and so on.

Figure 15:
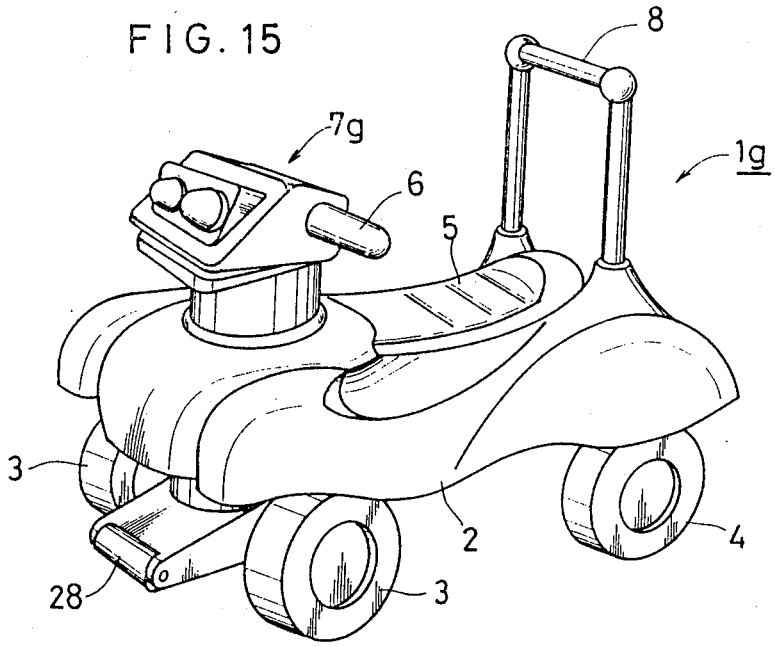
FIG. 15 is a perspective view showing the external appearance of a toy vehicle 1g according to an eighth embodiment of the invention.

FIG. 15 shows an eighth embodiment of the invention, particularly illustrating another modification of the formation on the upper end of the handle post. In FIG. 15, the portions corresponding to those shown in FIG. 1 are indicated by the same reference numerals, and a repetitive description thereof is omitted.

The toy vehicle 1*g* shown in FIG. 15 has a handle post 7*g* simulating the head of a robot. Grips 6 project laterally from said handle post 7*g*.

Various embodiments have been described so far, it being noted that the formation or structure provided to the handle post can be changed in many ways.

In each of the embodiments, described above, the handle post is rotated relative to the vehicle body by operating the grips; however, the invention is also applicable to toy vehicles of the type in which the handle post is fixedly attached to the vehicle body.

Although the present invention has been described and illustrated in detail, it is clearly understood that the same is by way of illustration and example only and is not to be taken by way of limitation, the scope of the present invention being limited only by the terms of the appended claims.

What is claimed is:

1. A toy vehicle comprising a vehicle body (2), front (3) and rear (4) rotatable wheels disposed under said toy vehicle to support said toy vehicle, an upper surface of said vehicle body being formed with a seat for a child to sit on, a handle post having child's grips, said handle post being disposed forwardly of said seat and projecting upwardly from the vehicle body, said handle post (7, 7*a*, 7*b*, 7*c*, 7*d*, 7*e*, 7*f*, 7*g*) comprising a structure whose external appearance or mechanism serves as a child's plaything, a first pillar (11, 12) extending downward from said vehicle body (2) for attaching an axle (31) for said rear wheels (4) to the lower end thereof, said handle post (7) including a second pillar (11, 12) extending downward from said vehicle body for attaching an axle (9) for said front wheels (3) to the lower end thereof, said first and second pillars comprising a plurality of tubular members that are telescopically slidably fitted together, wherein an overlap length of said tubular members is variable to adjust the respective lengths of said first and second pillars, said toy vehicle further comprising adjusted length maintaining means for adjusting said overlap length of said plurality of tubular members in at least two steps and maintaining the adjusted length in order to maintain the lengths of said first and second pillars.

2. The toy vehicle of claim 1, wherein one (11) of two mutually fittable tubular members selected from said plurality of tubular members is provided with positioning holes (20, 21) at a plurality of positions longitudinally along said tubular members, while the other (12) is formed with at least one hole (26), said adjusted length maintaining means comprising a pin (22) extending through said hole (20, 21) at either position on said one tubular member (11) and through the hole (26) of said other tubular member (12).

3. A toy vehicle comprising a vehicle body (2), front (3) and rear (4) rotatable wheels disposed under said toy vehicle to support said toy vehicle, an upper surface of said vehicle body being formed with a seat for a child to sit on, a handle post having child's grips, said handle post being disposed forwardly of said seat and projecting upwardly from the vehicle body, said handle post (7, 7*a*, 7*b*, 7*c*, 7*d*, 7*e*, 7*f*, 7*g*) comprising a structure whose external appearance or mechanism serves as a child's plaything, said handle post (7,7*a*, 7*b*) further comprising a pillar (11, 11*a*, 11*b*, 12, 12*a*, 12*b*), extending downward from said vehicle body (2) and having attached to the lower end thereof an axle (9) for said front wheels (3), said pillar comprising a first tubular member (11, 11*a*, 11*b*), a second tubular member (12, 12*a*, 12*b*) telescopically slidably fitted into said first tubular member, a cushioning coil spring (29, 29*a*, 29*b*) received in said space defined by said first and second tubular members, said coil spring acting in a direction to extract said first and second tubular members from each other, first and second spring support surfaces (16, 36, 16*b*, and 24, 24*a*, 24*b*) for receiving the ends of said coil spring, said spring support surfaces being formed in said space defined by said first and second tubular members (11, 11*a*, 11*b* and 12, 12*a*, 12*b*), said first spring support surface (16, 36, 16*b*) being fixedly provided on said first tubular member (11, 11*a*, 11*b*), said second spring support surface (24, 24*a*, 24*b*) being fixedly provided on said second tubular member (12, 12*a*, 12*b*), said first and second spring support surfaces being formed by first and second walls (16, 16*b*, and 11, 11*b*) extending from the inner peripheral surfaces of said first and second tubular members (11, 11*b*, and 12, 12*b*).

4. The toy vehicle of claim 3, wherein said first wall (16) is provided at a position deviated from the center of the length of said first tubular member (11), said first tubular member (11) being adapted to fit from either end thereof on the second tubular member (12), wherein an overlap length of the first and second tubular members (11 and 12) with said coil spring (29) received therebetween can be adjusted in two steps.

5. A toy vehicle comprising a vehicle body (2), front (3) and rear (4) rotatable wheels disposed under said toy vehicle to support said toy vehicle, an upper surface of said vehicle body being formed with a seat for a child to sit on, a handle post having child's grips, said handle post being disposed forwardly of said seat and projecting upwardly from the vehicle body, said handle post (7, 7*a*, 7*b*, 7*c*, 7*d*, 7*e*, 7*f*, 7*g*) comprising a structure whose external appearance or mechanism serves as a child's plaything, said handle post (7, 7*a*, 7*b*) further comprising a pillar (11, 11*a*, 11*b*, 12, 12*a*, 12*b*) extending downward from said vehicle body (2) and having attached to the lower end thereof an axle (9) for said front wheels (3), said pillar comprising a first tubular member (11, 11*a*, 11*b*), a second tubular member (12, 12*a*, 12*b*) telescopically slidably fitted into said first tubular member, a cushioning coil spring (29, 29*a*, 29*b*) received in said space defined by said first and second tubular members, said coil spring acting in a direction to extract said first and second tubular members from each other, first and second spring support surfaces (16, 36, 16*b*, and 24, 24*a*, 24*b*) for receiving the ends of said coil spring, said spring support surfaces being formed in said space defined by said first and second tubular members (11, 11*a*, 11*b*, and 12, 12*a*, 12*b*), said first spring support surface (16, 36, 16*b*) being fixedly provided on said first tubular member (11, 11*a*, 11*b*), said second spring support surface (24, 24*a*, 24*b*) being fixedly provided on said second tubular member (12, 12*a*, 12*b*), said first spring support surface being formed by a first spring support wall (36) provided on a spring support member (34) disposed in said first tubular member (11*a*), said second spring support surface being formed by a second spring support wall (24*a*) extending from the inner peripheral surface of said second tubular member (12*a*).

6. The toy vehicle of claim 5, wherein said spring support member (13) is cylindrical and has an outwardly extending flange (35), said first spring support wall (36) extending from the inner peripheral surface of the spring support member at a position different from the position of said flange on the axis of said cylindrical spring support member, the inner peripheral surface of said first tubular member (11*a*) being formed with a step portion (32) for receiving said flange, whereby the orientation of said spring support member is inverted to invert the positional relationship of said first spring support member to said flange, so that an overlap length of the first and second tubular members (11*a* and 12*a*) with said cushioning coil spring (29*a*) held between said first and second spring support walls (36 and 24*a*) can be adjusted in two steps.

7. A toy vehicle comprising a vehicle body (2), front (3) and rear (4) rotatable wheels disposed under said toy vehicle to support said toy vehicle, the upper surface of said vehicle body being formed with a seat for a child to sit on, a handle post having child's grips, said handle post being disposed forwardly of said seat and projecting upwardly from the vehicle body, said handle post (7*f*) forming a peep toy, said peep toy comprising a light inlet opening (60), a prism (62) adapted to be rotated around its own axis, said prism having sides located for receiving light from said light inlet opening, each side of said prism forming a reflecting mirror (63, 64, 65) for reflecting light which enters through said light inlet opening, and a peep window (61) for viewing the light reflected from said reflecting mirror.

* * * * *